US008935972B2

(12) United States Patent
Farrell

(10) Patent No.: US 8,935,972 B2
(45) **Date of Patent: *Jan. 20, 2015**

(54) FIREFIGHTER TOOL

(71) Applicant: Terry C. Farrell, Conneaut Lake, PA (US)

(72) Inventor: Terry C. Farrell, Conneaut Lake, PA (US)

(73) Assignee: Channellock, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/913,607

(22) Filed: Jun. 10, 2013

(65) Prior Publication Data

US 2014/0026329 A1 Jan. 30, 2014

Related U.S. Application Data

(63) Continuation of application No. 11/857,010, filed on Sep. 18, 2007, now Pat. No. 8,485,074, which is a continuation-in-part of application No. 11/493,682, filed on Jul. 26, 2006, now abandoned.

(51) Int. Cl.

| | |
|---|---|
| ***B25B 7/22*** | (2006.01) |
| ***B25F 1/00*** | (2006.01) |
| ***A62C 99/00*** | (2010.01) |
| ***B25B 13/48*** | (2006.01) |
| ***B25B 13/50*** | (2006.01) |

(52) U.S. Cl.

CPC . *B25B 7/22* (2013.01); *A62C 99/00* (2013.01); *B25B 13/48* (2013.01); *B25B 13/50* (2013.01)

USPC ..... 81/415; 7/138

(58) Field of Classification Search

CPC ..... B25B 7/00; B25B 7/02; B25B 7/08; B25B 7/22; B25B 13/48; B25B 13/50; B25F 1/003; B25F 1/006; B25G 1/102; B25G 1/105; A62B 3/00; A62B 3/005; A62C 33/00; A62C 99/00; E03B 9/02; F16K 35/06

USPC ..... 81/415, 427.5, 416, 318, 418; 7/125–128, 138, 166, 161

See application file for complete search history.

(56) References Cited

U.S. PATENT DOCUMENTS

| | | | | |
|---|---|---|---|---|
| 4,744,272 A * | 5/1988 | Leatherman | ..... | 81/427.5 |
| 4,919,021 A * | 4/1990 | Franks | ..... | 81/418 |
| 7,353,736 B2 * | 4/2008 | Poehlmann | ..... | 81/427.5 |

* cited by examiner

*Primary Examiner* — Hadi Shakeri

(74) *Attorney, Agent, or Firm* — Lackenbach Siegel, LLP

(57) ABSTRACT

A firefighter tool has pivotably connected handles and jaws, and one handle has an outer generally sinusoidal surface and the handle end is formed with a hook facingly disposed to the generally sinusoidal surface. The handles open fully so that the user grips the other handle and the sinusoidal surface hook alternately operably contactingly engages differently sized and configured fire hose couplings.

12 Claims, 11 Drawing Sheets

FIREFIGHTER TOOL

PRIOR RELATED APPLICATIONS

This application is a continuation of application Ser. No. 11/857,010, filed Sep. 18, 2007, now U.S. Pat. No. 8,485,074, which is a continuation-in-part of application Ser. No. 11/493,682, filed Jul. 26, 2006, and claims priority thereto and incorporates the priority applications herein in their entireties by reference thereto.

BACKGROUND OF THE INVENTION

1. Field of the Invention

This invention relates to hand tools. This invention specifically relates to hand tools having multiple functionalities. This invention more specifically relates to a firefighter tool having multiple functionalities.

2. Background of the Prior Art

Firefighter tools having multiple functions are disclosed in U.S. D210,141, granted Feb. 13, 1968 to Woods; U.S. D226,162, granted Jan. 30, 1973 to Zlayele, Jr., U.S. D233,405, granted Oct. 29, 1974 to Frey; U.S. D244,252, granted May 10, 1997 to Ardis; U.S. D281,216, granted Nov. 5, 1985 to Cutliff, Jr, et al.; U.S. D329,972, granted Oct. 6, 1992 to Calvagno; U.S. Pat. No. 1,561,647, granted Nov. 17, 1925 to Johnson; U.S. Pat. No. 2,360,163, granted Oct. 10, 1944 to Sadler; U.S. Pat. No. 3,599,255 granted Oct. 21, 1968 to Carroll, Sr.; U.S. Pat. No. 3,949,439, granted Apr. 13, 1976 to Ardis; U.S. Pat. No. 4,287,623, granted Sep. 8, 1981 to Tarran; U.S. Pat. No. 4,597,123, granted Jul. 1, 1986 to Cobe, Jr.; U.S. Pat. No. 4,646,378, granted Mar. 3, 1987 to Borden; U.S. Pat. No. 5,105,493, granted Apr. 21, 1992 to Lugtenaar; U.S. Pat. No. 5,428,853, granted Jul. 4, 1995 to Menke; U.S. Pat. No. 6,308,355, granted Oct. 30, 2001 to McMillan et al.; U.S. Pat. No. 6,397,420, granted Jun. 4, 2002 to Roxton; U.S. Pat. No. 6,899,001, granted May 31, 2005 to Sanders et al.; and US Publication 2004/0261188, published Dec. 30, 2004 to Mathis.

The wrench art generally disclosed a unitary member and hook for effectively engaging one specifically sized coupling as disclosed in U.S. D138,515 to Hardy, U.S. D337,492 to Ryan et al. and U.S. Pat. No. 6,705,182 to Bennett.

The firefighter wrench art was directed to a movable or displaceable hook or other movable element in order to engage diversely sized couplings as disclosed in U.S. Pat. No. 6,298,754 to Brown, U.S. Pat. No. 1,936,359 to Huthsing et al. U.S. Pat. No. 5,428,853 to Menke et al., U.S. Pat. No. 5,247,715 to Nishiguchi.

Referring specifically to FIG. 1 (Prior Art), there is shown the multi-purpose rescue tool disclosed in US Publication No. 2006/015674, published Jul. 20, 2006 to Gillingham ("the Gillingham tool"). The Gillingham tool 1 includes a handle 8 with a planar contact surface 2 for engaging small sized fire hose couplings (not shown), wherein there is line contact between the cylindrical surface of the coupling and the handle planar contact surface 2. The Gillingham hook end 3 is curved with a terminal sharp edge which has a limited range of utility the Gillingham tool is only operable with the handles in the closed position. This is because the handles open to only a limited degree, and the arm 4 and cutter 5 disposed in the inside 6 of handle 7 prevent a user from griping the handle 7.

The art desires a firefighter tool that is operable with diversely sized and configured couplings, and wherein a large force may be asserted to readily and effectively rotate and uncouple the diversely sized and configured couplings, particularly where the couplings are seized tight.

The present invention provides a firefighter tool that meets the foregoing art needs.

SUMMARY OF THE INVENTION

The invention in one principal aspect is a tool member that is a wrench construction having the combination of a generally sinusoidal curvature or surface and a hook disposed at an end of the member and in facing disposition to the generally sinusoidal surface. The combination of the generally sinusoidal surface and the facingly disposed hook permits a user to variously operably engage diversely sized and configured couplings. The present tool engages fire hose couplings of from about 1½" to 5" in diameter having from 2 to 6 lugs or ears. The tool member, in one embodiment, may be of one-piece unitary construction.

The invention, in another respect, is a tool that has two members, and each member has a distal end formed with a jaw, and a proximate end formed with one or more grip portions, and a pivot member disposed between the respective ends, so that as pliers the handles open and close the jaws and one member having the afore-discussed combination of the generally sinusoidal curvature or surface and the facingly disposed hook formed at the proximate end of the one member. The user may employ the wrench with the handles opened or closed. The pliers are configured to open so that the fully opened handles subtend an angle of at least about 70°. The user in one mode of operation grips one handle and exerts a large force, through bearing surfaces on the opened jaws, to the wrench end generally sinusoidal surface and to the hook to quickly open seized fire hose couplings.

The sinusoidal curvature or surface includes a convex surface and a contiguous concave surface. The radii of the convex and concave surfaces are about equal. The concave surface is disposed more adjacent to the proximate end of one member than the distal end. The inflection or transition surface disposed between the concave and convex curvatures is generally the contact engagement surface. With the wrench sinusoidal surface engaging each respective coupling cylindrical surface, there is, in contradistinction to a line contact between the coupling cylindrical surface and of the wrench contact surface of the Gillingham tool, an engagement surface area.

The present hook construction extends from the proximate end to the distal end. The hook distal portion or end face has a generally rectilinear construction and a planar angled face. This hook construction provides an operable bearing surface for diversely sized and configured lugs or ears that extend radially outwardly from the coupling cylindrical surface.

The present firefighter tool is diversely operable with diversely sized and configured fire hose couplings. In use, the present firefighter tool exerts a large torque force and readily rotates and uncouples couplings that are seized tight.

DESCRIPTION OF THE INVENTION

Figure 1:
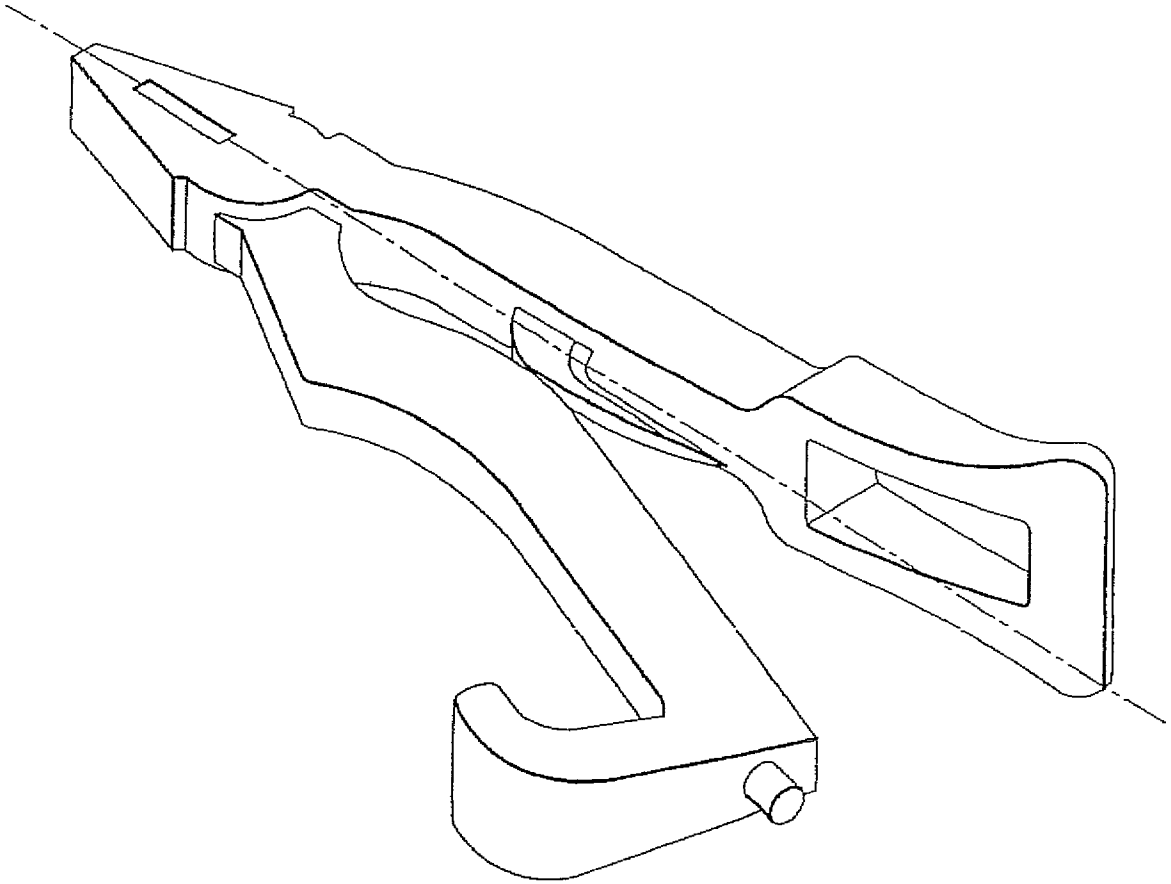
FIG. 1 PRIOR ART
FIG. 1. is a proximate end perspective view of a PRIOR ART multi-purpose rescue tool.
Figure 2:
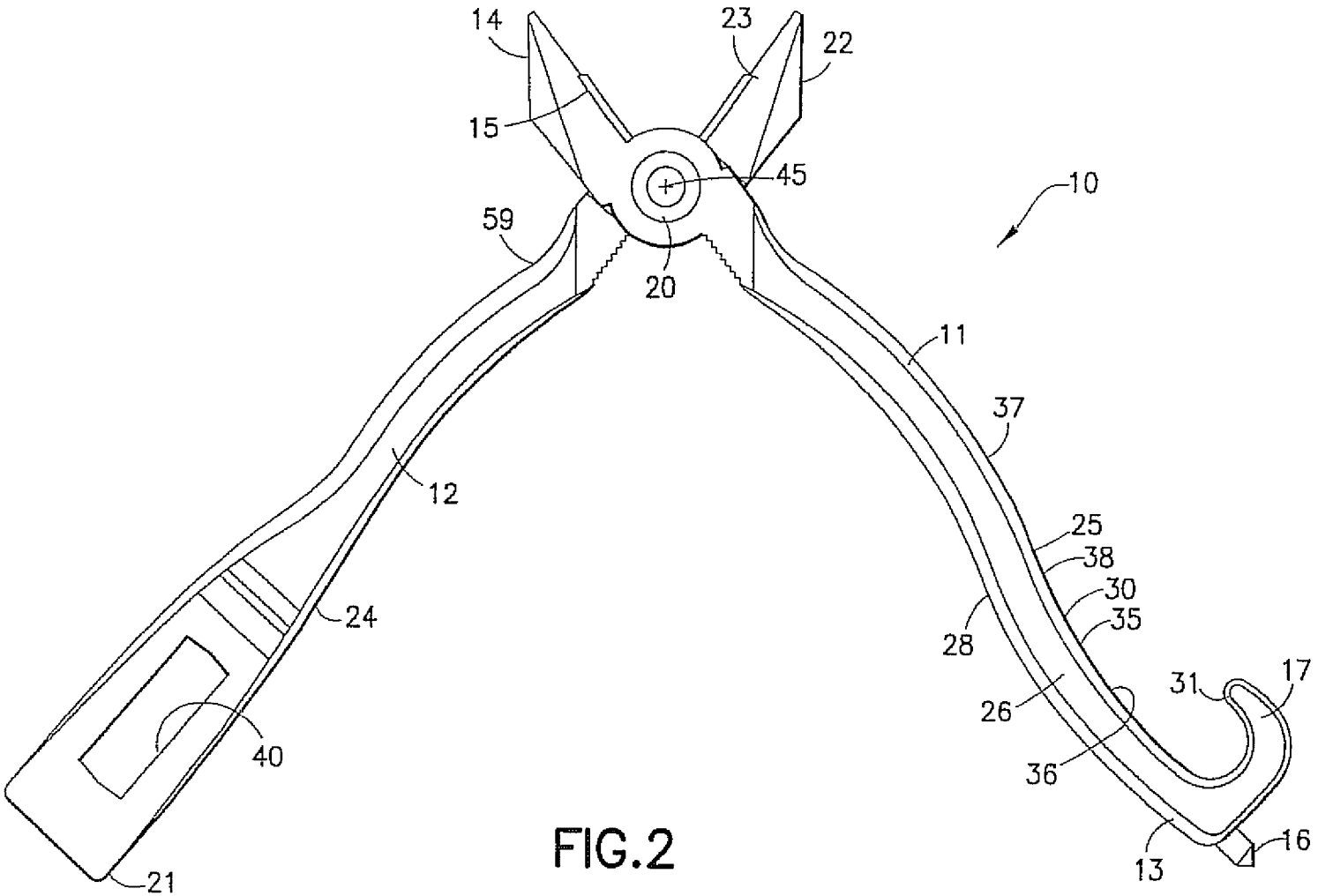
FIG. 2. is a front elevational view of the firefighter tool of the present invention in the fully opened position.

Referring to FIGS. 2-7 and 9, there is shown firefighter tool 10. Tool 10 includes members 11 and 12, pivotally connected by pivot member 20. Member 11 has a proximate end 13 and a distal end 14. Distal end 14 includes jaw 15. Proximate end 13 includes proximately disposed pin 16 and distally extending hook 17, and hook end 31 for purposes hereinafter appearing. Member 12 has a proximate end 21 and a distal end 22. Distal end 22 includes jaw 23. Member 12 includes handle portion 24. Member 11 includes handle portion 25 (see e.g., FIG. 6). Jaws 15 and 23 pivotably open and close with the movement of the handle portions 24 and 25, by pivot member 20.

Handle 25 is formed with a front surface 26, a rear surface 27, an inner surface 28 and an outer surface 30. Outer surface 30 is specifically configured in a generally sinusoidal curvature 35. Surface curvature 35 includes a proximately disposed concave portion 36, a convex portion 37, and an intermediate or transitional portion 38, for purposes hereinafter appearing. The respective radii of curvatures 36 and 37 are about equal. Handle 24 includes a wedge 39 formed at proximate end 21. A through hole wrench 40 is disposed between handle portion 24 and wedge 39. Through hole 40 is a parallel disposition with pivot axis 45 of pivot member 20.

Figure 3:
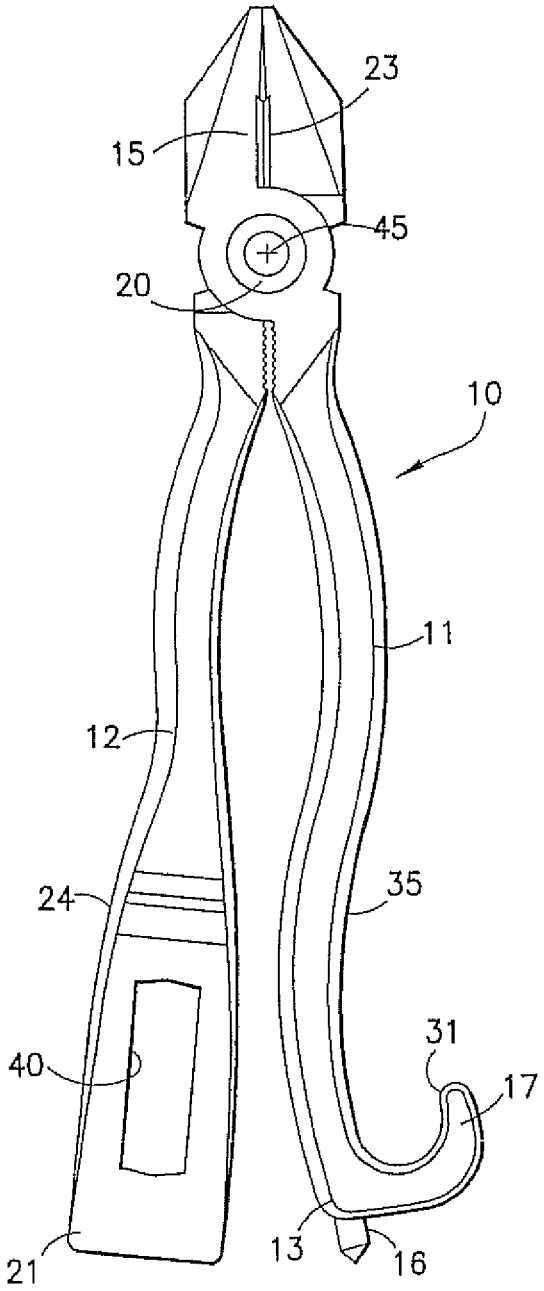
FIG. 3. is a front elevational view of the firefighter tool of FIG. 2 in the fully closed position.
Figure 4:
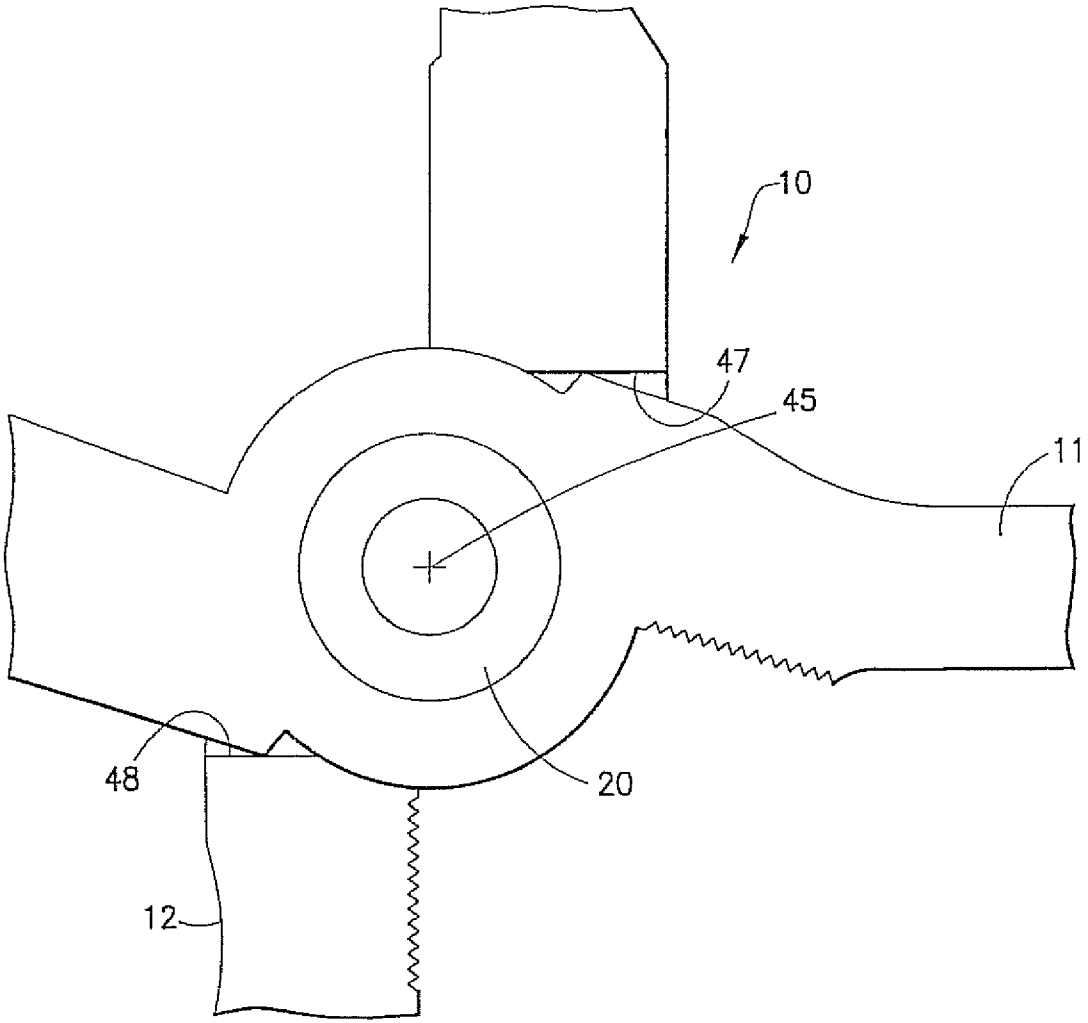
FIG. 4. is a greatly enlarged fragmentary view of the pivot assembly as shown in FIG. 2.

Referring specifically to FIG. 3, there is shown tool 10 in the fully closed position. Jaws 15 and 23 are contactingly engaged. A user (not shown) can grip closed jaws 15 and 23 and use wedge 21 or wrench 40 of member 12. The user (not shown) can otherwise grip closed jaws 15 and 23 and use configured surface 35 in cooperation with hook end 31 for uncoupling a fire hose coupling, as more fully discussed hereinafter.

Figure 5A:
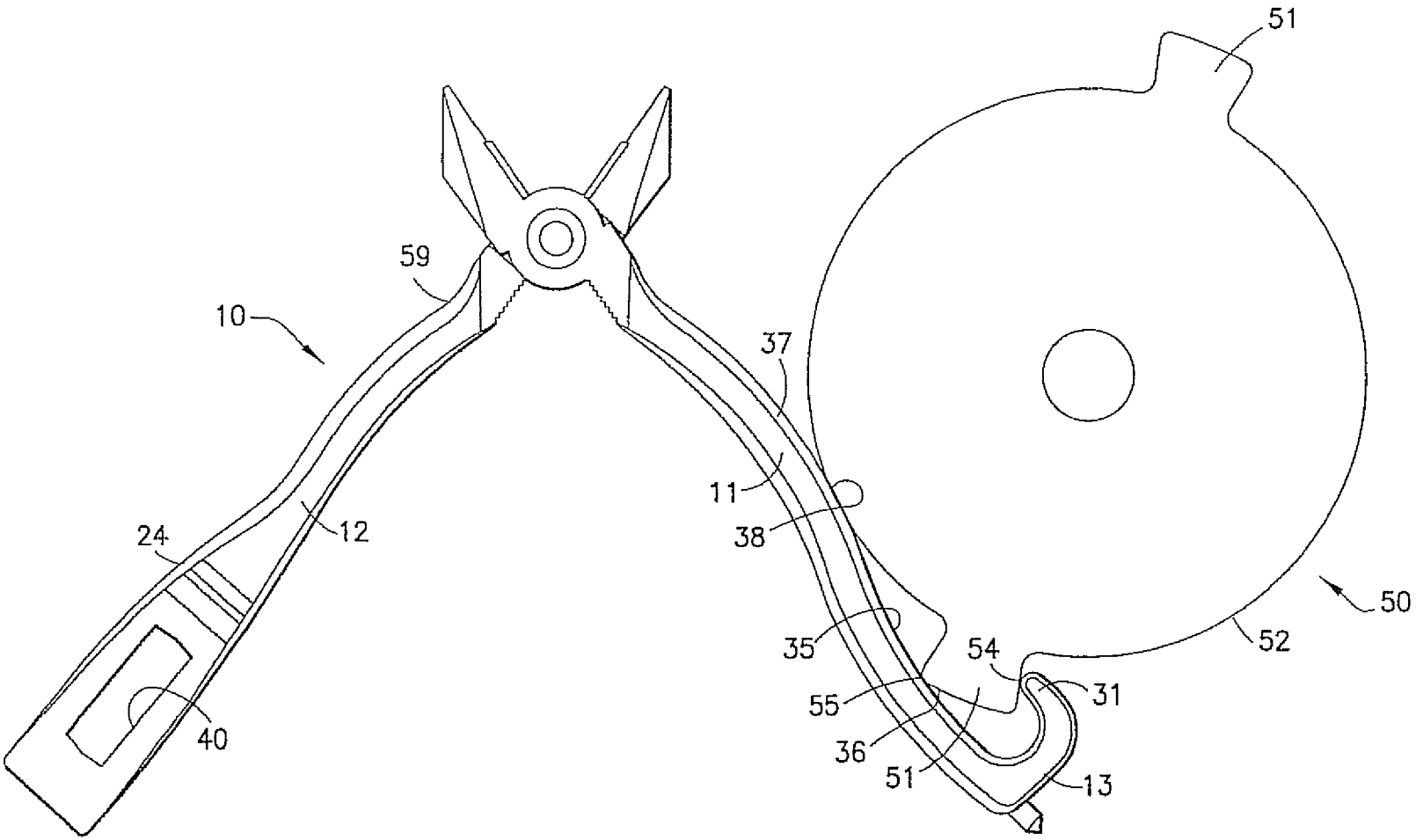
FIG. 5A. is a front elevational view of the firefighter tool of FIG. 2 in use with a fire hose coupling of a first size.

Referring specifically to FIG. 5A there is shown firefighter tool 10 in the fully opened position. Tool 10 is shown in operable engagement with a 5" fire hose coupling 50. Coupling 50 has 2 radially extending lugs 51 (typical), and cylindrical surface 52. It is understood that fire hose couplings are differently diametrically sized with differently configured and numbered lugs.

Figure 5B:
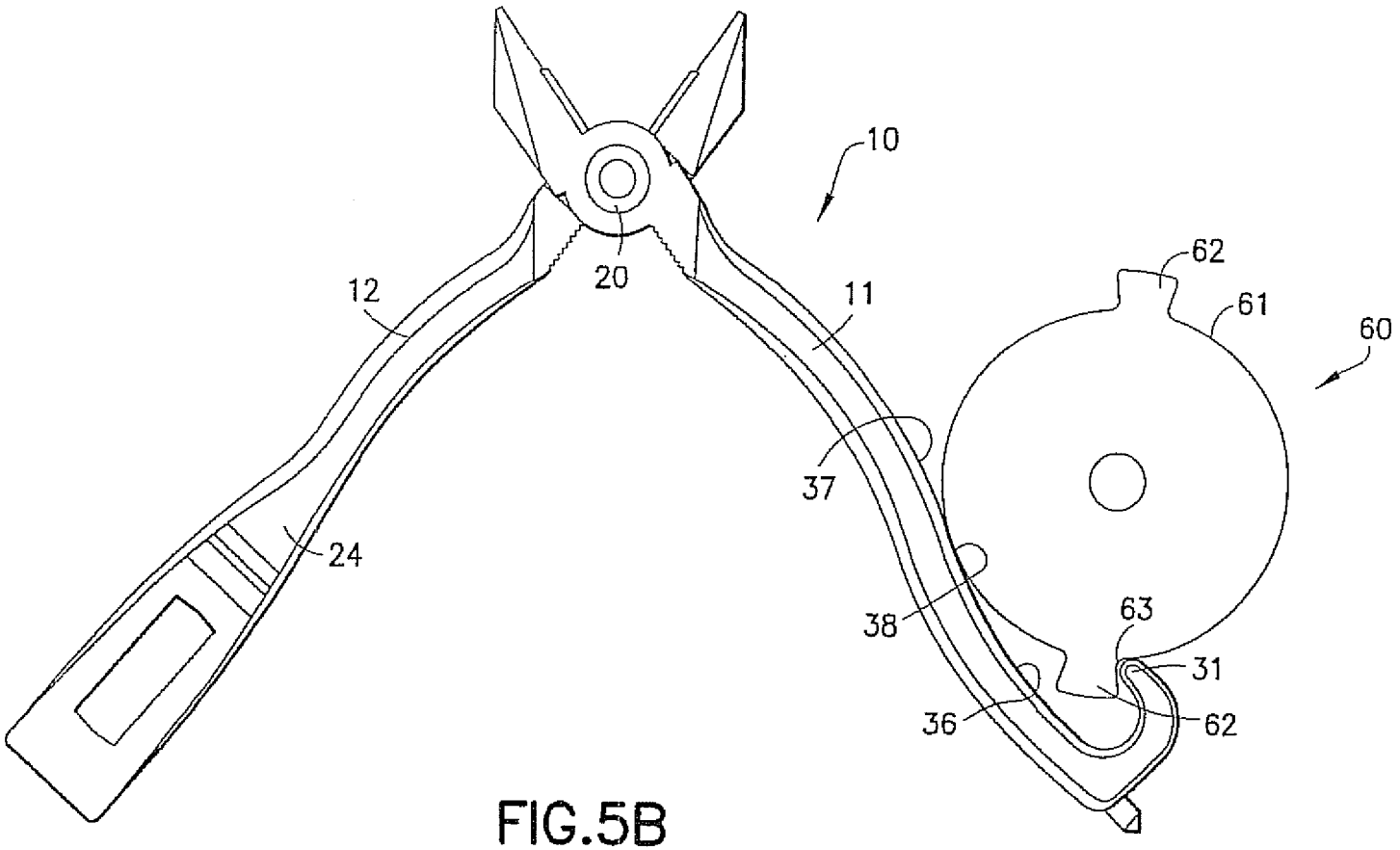
FIG. 5B. is a front elevational view of the firefighter tool of FIG. 2 in use with a fire hose coupling of a second size.
Figure 5C:
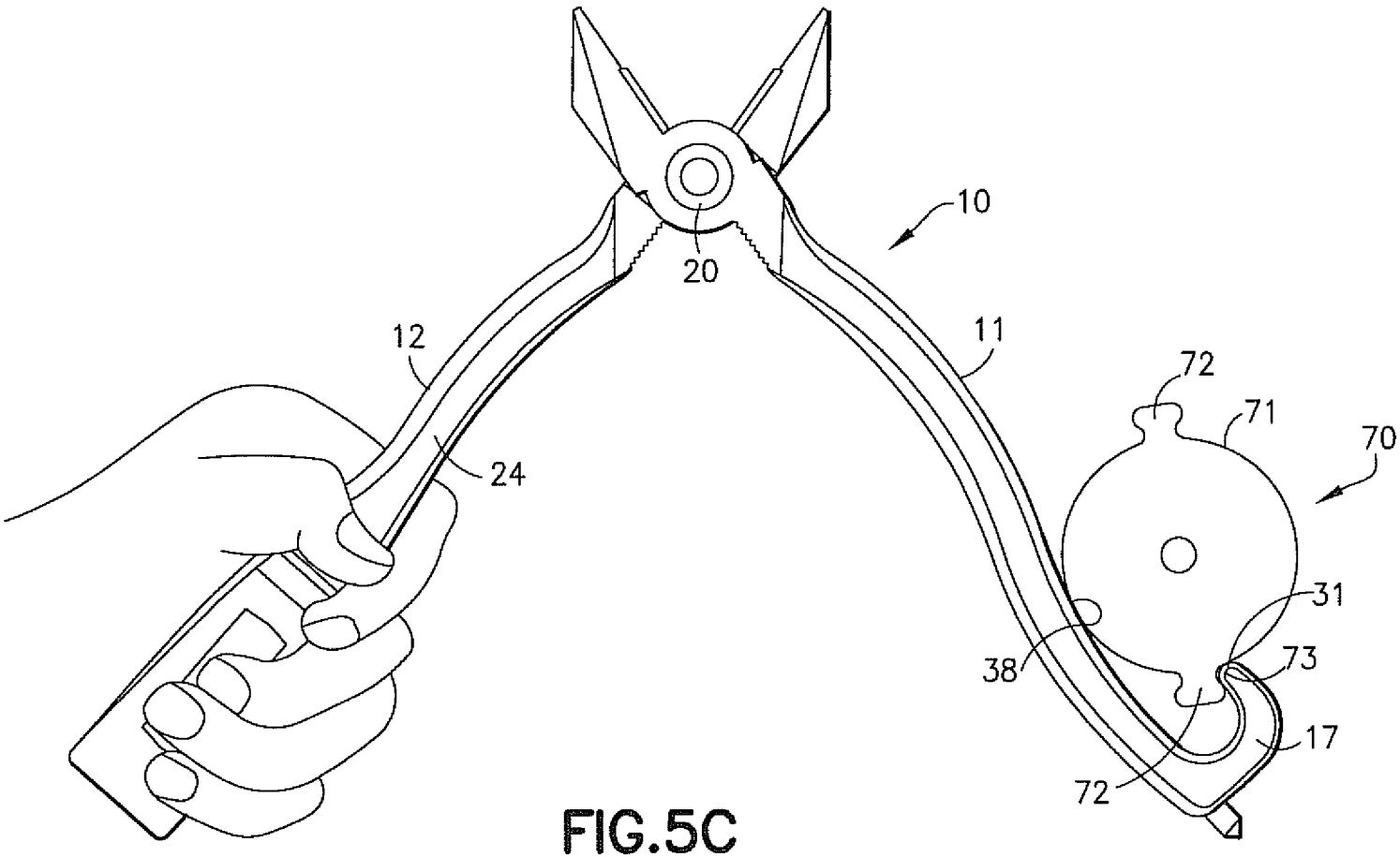
FIG. 5C. is a front elevational view of the firefighter tool of FIG. 2 in use with a fire hose coupling of a third size.

The user grips handle 24 of member 12 and disposes the thumb towards the proximately disposed wedge 39 and causes hook end 31 in combination with facingly opposed surface 35 to engage coupling 50 (FIG. 5C). With respect to the 5" coupling, hook end 31 engages lug recess 54, concave surface 36 lug engages corner edge 55, and transitional surface 38 engages coupling cylindrical surface 52 (FIG. 5A). The user then exerts an upward force on member 12, which force is transmitted through bearing surfaces 47 and 48 (FIG. 4) to member 11. The exerted force is in turn transferred through surfaces 38 and 36, and hook end 31 to coupling 50 to rotate (counter clockwise as shown in FIG. 5A) to uncouple coupling 50. The present construction is designed to cause member 11 and 12 to open to at least about a 70° angle (FIG. 9) when operated in the fully opened mode. This large angular disposition in combination with the force transfer bearing surfaces 47 and 48 cause a substantial torque to be exerted on the coupling. It has been found that when a 250 lb. force is exerted on handle 24 in both the upward and sideward directions a resultant 354 lb. force is generated at 45°. Further, a Von Mises (WCS) stress analysis reveals that the area of highest stress is not in the pivot member 20 area but rather at portion 59 of member 12. The pivot member 20 and bearing surfaces 47 and 48 were found to be surprisingly under low stress. This construction permits an effective torque.

Referring specifically to FIG. 5B, there is shown tool 10 in operable engagement with 3" coupling 60. Coupling 60 includes cylindrical surface 61 and lugs 62. Lug 62 (typical) and cylindrical surface 61 converge at recess 63. The user grips handle 24 and causes hook end tip 31 to be inserted in recess 63, with transitional surface 38 contactingly engaged with coupling cylindrical surface 61. The user then exerts an upward force on handle 24 to generate a resultant torque force on coupling 60.

Referring specifically to FIG. 5C, there is shown tool 10 in operable engagement with 1½"-2" coupling 70. Coupling 70 includes cylindrical surface 71 and lugs 72. Lug 72 (typical) and cylindrical surface 71 converge at recess 73. The user grips handle 24 and causes hook end 31 to fit into recess 73 and transitional surface 38 to contactingly engage cylindrical surface 71. The user then, in a likewise manner, exerts an upward force to generate a resultant torque force on coupling 70.

Figure 6:
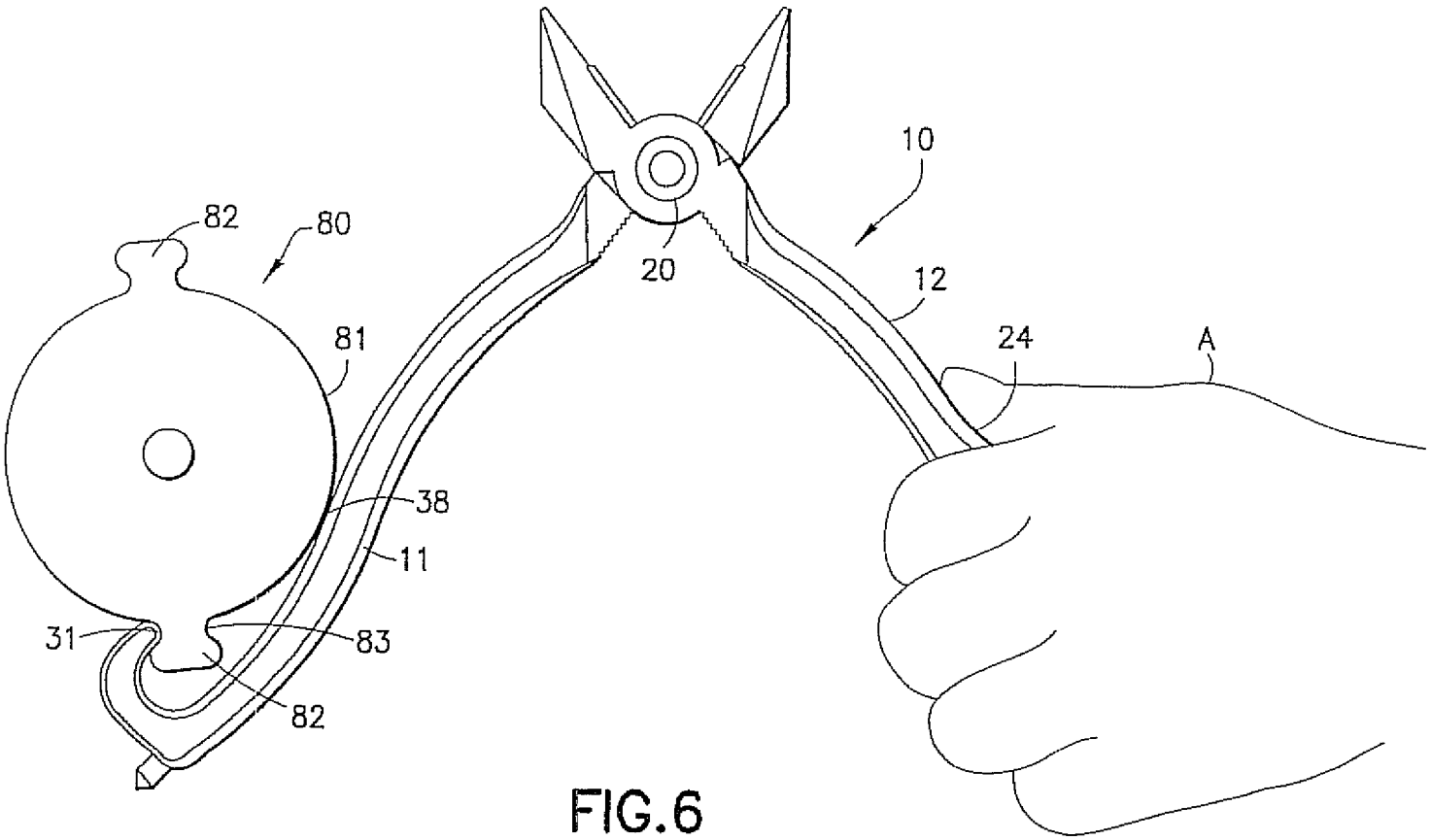
FIG. 6. shows the firefighter tool as in FIG. 5B being operably equipped by the firefighter.

Referring specifically to FIG. 6, there is shown a reverse side elevational view of tool 10 in operable engagement with 3" coupling 80. Coupling 80 differs from coupling 70 in that the lugs 82 are differently configured than lugs 72. The user A causes hook tip 31 to be inserted in recess 83 and transitional surface 38 to contactingly engage cylindrical surface 81. A torque force is then exerted in the above-described manner. FIGS. 5A-5C and 6 demonstrate the fully opened mode tool 10 in operable engagement with differently sized and configured fire hose couplings. The present invention provides a universal tool for readily uncoupling diversely sized and configured fire hose couplings.

Figure 7:
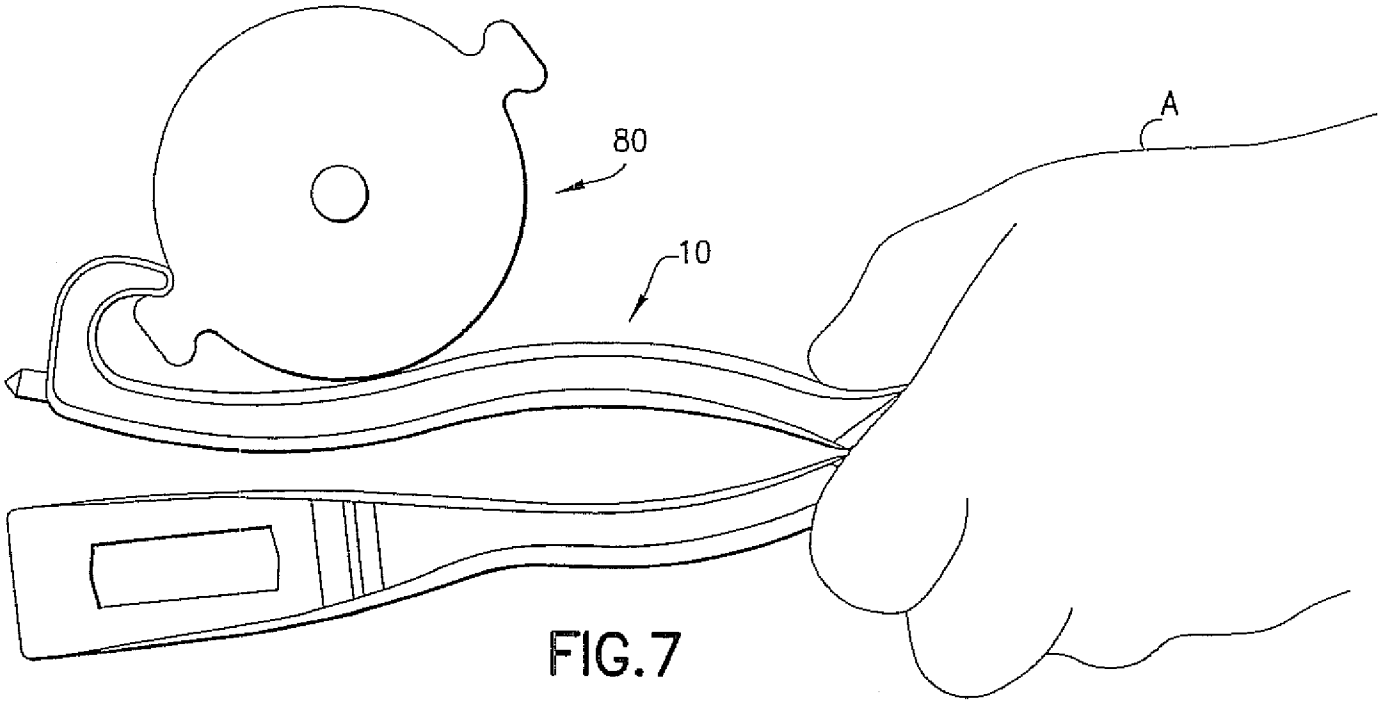
FIG. 7. shows the firefighter tool as in FIG. 3 being operably gripped by the firefighter.

Referring specifically to FIG. 7 there is shown tool 10 in the fully closed mode in operable engagement with coupling 80. The user A grips the surfaces formed by closed jaws 15 and 23, and exerts a downward force to uncouple coupling 80.

Figure 9:
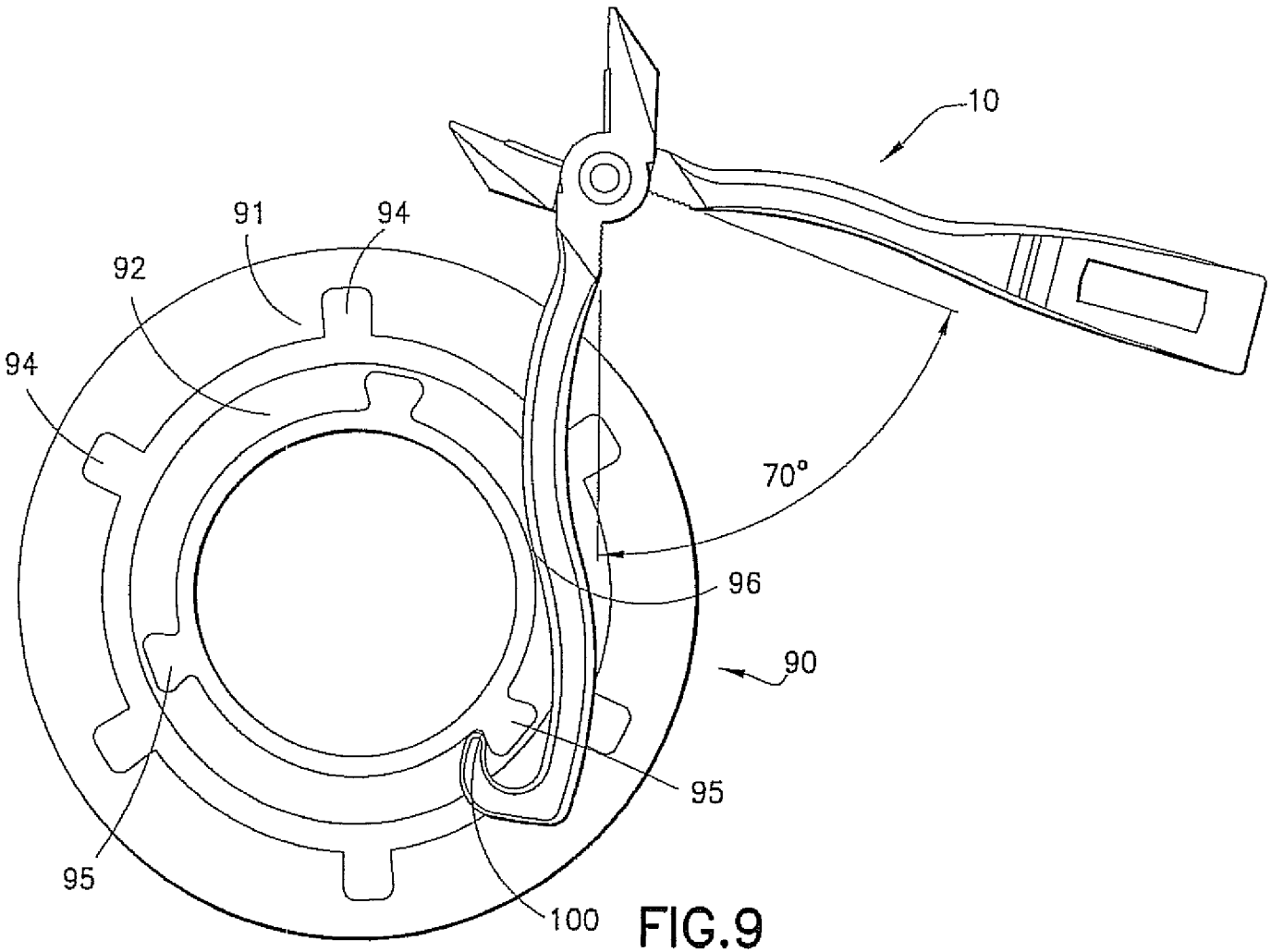
FIG. 9. is the firefighter tool of FIG. 2 operably engaging a 3" reducing coupling of a 5" coupling.

Referring specifically to FIG. 9, there is shown tool 10 in the fully opened mode in operable engagement with a standard 5" to 3" reduction coupling 90. Reduction coupling 90 is a one-piece unitary forge metal or molded impact resin construction, as is well known in the firefighter tool art. Reduction coupling 90 is formed with a rearwardly disposed 5" coupling engagement portion 91, and a forwardly disposed 3" coupling 92. Portion 91 is designed to fit over or cover standard 5" couplings. The six lug covers 94 engage two or more of the respective 5" coupling lugs. In this manner of construction, the 5" coupling is reduced to a 3" coupling. The resultant 3" coupling is designed with 3 lugs 95. Tool 10 engages one lug 95 and cylindrical surface 96. The user causes the 3" coupling and in turn the entire reduction coupling 90 to rotate and in turn uncouple the reduction coupling 90 covered 5" coupling (not shown).

Figure 8:
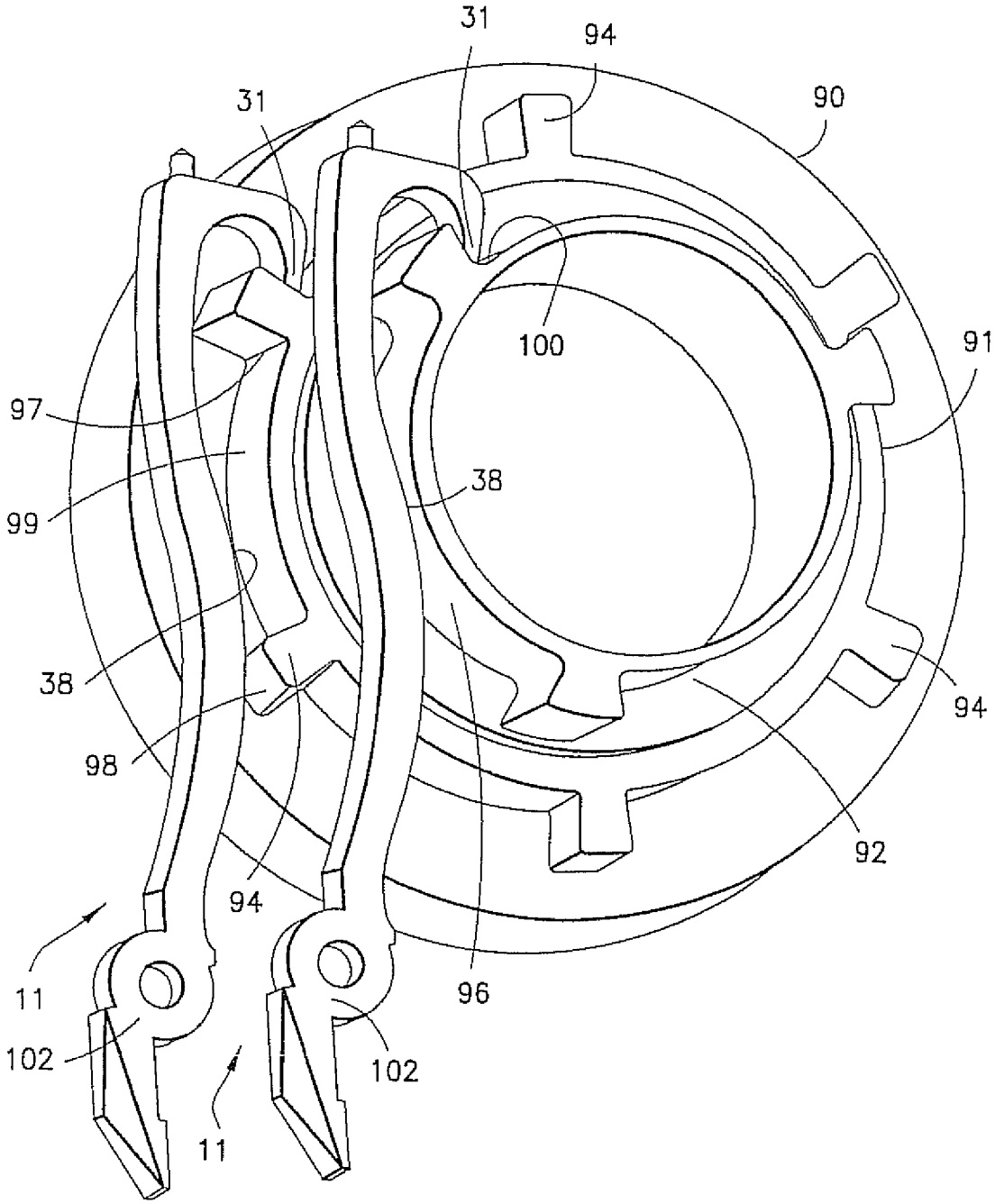
FIG. 8. shows an alternate embodiment of the firefighter tool, alternatively engaging a 3" coupling with a 5" coupling.

Referring now specifically to FIG. 8, there is shown a second embodiment of the present inventories. In this embodiment, member 11 itself is utilized as a fire hose uncoupling tool. Member 11 is shown in alternate operable engagement of the 5" coupling portion 91 and the 3" coupling portion 92. In the 3" coupling portion 92 engagement, hook tip 31 engages recess formed between lug 94 and cylindrical surface 96 and transitional surface 38 contactingly engages cylindrical surface 96. The user grabs member 11 at the jaw and pivot surfaces 102 and exerts a downward force to cause rotation of reduction coupling 90. In the 5" coupling portion 91 engagement, hook tip 31 fits into recess 100 and convex surface 37 contactingly engages the outer surface 98 of lug 94. Transitional surface 38 does not contactingly engage and is systematically disjoined from 5" cylindrical surface 99. FIG. 8 demonstrates the use of one-piece unitary member 11 as a universal uncoupling tool.

It is understood and within the contemplation of the present invention to provide a one-piece unitary forged tool where a forged handle or ergonomic handle may be provided in lieu of the surfaces 102.

The other firefighter elements e.g. wrench 40, wedge 21, pin 16 and jaws 15 and 23 are used in the manner described in application Ser. No. 11/493,682, filed Jul. 26, 2006, published Jan. 31, 2008 as Publ. No. US2008/0022815, which application is incorporated herein in its entirety by references thereto.

While the present invention has been described by reference to a specific embodiment, it should be understood that modifications and variations of the invention might be constructed without departing from the scope of the invention as defined in the appended claims.

What is claimed is:

1. A method for operating a rescue tool for uncoupling a seized coupling or cap, comprising:

(a) engaging a seized coupling or cap having a cylindrical surface and a plurality of lugs with a rescue tool, said rescue tool comprises a first member comprising a proximate end and a distal end comprising a proximately disposed first handle and a distally disposed first jaw; a second member comprising a proximate end and a distal end comprising a proximately disposed second handle and a distally disposed second jaw; and means for pivotably connecting the members comprising a pivot axis, being disposed between the handles and jaws so that the handles pivotably move from a closed position to a fully opened position; said first handle comprises a wedge having a through hole; and said first handle further comprises a grip portion extending between the wedge and the jaws; said second handle comprises a hook disposed at the proximate end for contacting engagement with one of the lugs, said second handle further comprises a curved surface in facing disposition with the hook for operably engaging a coupling or a cap, wherein the second handle curved surface comprises a generally sinusoidal surface comprising a convex portion and a concave portion having a transitional surface between the convex and concave portions in contacting engagement with the coupling or cap cylindrical surface; and further comprising (b1) gripping the first handle grip portion, so that the gripping extends between the wedge and jaws, said first handle grip portion further comprises a front surface, and a rear surface, an inner surface and an outer surface, (b2) disposing the thumb on the front surface, (b3) extending the thumb towards the wedge, and said gripping extending to the first handle inner surface, and further comprising (b4) exerting a leverage force from the grip portion distally through the jaws to the second handle transitional surface;

wherein with the first handle gripped and the leverage force exerted from the first handle through the jaws to the second handle transitional surface and in turn to the coupling or cap cylindrical surface with the hook contactingly engaged with a lug, and wherein with the handles fully opened a greater resultant torque force is generated than with the handles closed so that the seized coupling or cap is more readily uncoupled.

2. The method of claim 1, wherein step (b3) further comprises opening the handles, wherein the handles are fixedly disposed at up to 114° in the fully opened position.

3. The method of claim 1, further comprising (c) inserting the wedge in a seized window edge and exerting a leverage force to open the seized window.

4. The method of claim 1, wherein prior to step (a) providing the tool to a firefighter for operating the rescue tool in a rescue operation.

5. The method of claim 1, wherein a jaw surface and an opposed contactingly engaged handle surface comprise contactingly engaged force bearing surfaces with the handles fully opened.

6. The method of claim 1, further comprising opening the handles from the closed position to the fully opened position before exerting the leverage force to achieve the greater resultant torque force.

7. The method of claim 1, wherein the gripping of the first handle grip portion is disposed immediately adjacent the wedge through hole.

8. The method of claim 1, wherein step (b2) further comprises arcuately moving the gripped first handle so that the jaws move around the coupling or cap with the coupling or cap directly contactingly engaged at the transitional surface.

9. A method for operating a rescue tool for uncoupling a seized coupling or cap, comprising:

(a) engaging a seized coupling or cap having a cylindrical surface and a plurality of lugs with a rescue tool, said rescue tool comprises a first member comprising a proximate end and a distal end comprising a proximately disposed first handle and a distally disposed first jaw; and a second member comprising a proximate end and a distal end comprising a proximately disposed second handle and a distally disposed second jaw; and means for pivotably connecting the members comprising a pivot axis, being disposed between the handles and jaws so that the handles pivotably move from a closed position to a fully opened position; said first handle comprises a proximately disposed wedge; and said first handle further comprises a grip portion extending between the wedge towards the jaws; said second handle comprises a hook disposed at the proximate end for contacting engagement with one of the lugs, said second handle further comprises a curved surface in facing disposition with the hook for operably engaging the coupling or a cap, and wherein the second handle curved surface comprises a generally sinusoidal surface comprising a convex portion and a concave portion and a transitional surface disposed between the convex and concave portions for contacting engagement with the coupling or cap cylindrical surface; and further comprising (b1) gripping the first handle grip portion with the grip extending between the wedge and the jaws, said first handle grip portion further comprises a front surface, a rear surface, an inner surface and an outer surface, and said gripping the first handle grip portion comprising gripping between the wedge and the jaws and (b2) disposing the thumb on the front surface, (b3) extending the thumb towards the wedge through hole, said second handle comprises a front surface disposed in the same plane of the first handle front surface, wherein the gripping the first handle grip portion does not contactingly engage the second handle front surface, and further comprising (b4) exerting a leverage force from the grip portion distally through the jaws to the second handle transitional surface;

wherein with the handles fully opened a greater resultant torque force is generated than with the handles closed so that the seized coupling or cap is more readily uncoupled.

10. The method of claim 9, said grip portion being disposed adjacent the wedge.

11. The method of claim 9, further comprising opening the handles from the closed position to the fully opened position before exerting the leverage force to achieve the greater resultant torque force.

12. The method of claim 9, wherein step (b2) further comprises arcuately moving the gripped first handle so that the jaws move around the coupling or cap with the coupling or cap directly contactingly engaged at the transitional surface.

* * * * *